US006658224B2

(12) United States Patent
Yokoi et al.

(10) Patent No.: US 6,658,224 B2
(45) Date of Patent: Dec. 2, 2003

(54) PROCESS CARTRIDGE AND ELECTROPHOTOGRAPHIC IMAGE FORMING APPARATUS

(75) Inventors: Akiyoshi Yokoi, Shizuoka (JP); Kazushi Watanabe, Shizuoka (JP); Toshiyuki Karakama, Shizuoka (JP); Toru Oguma, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/084,430

(22) Filed: Feb. 28, 2002

(65) Prior Publication Data

US 2002/0122674 A1 Sep. 5, 2002

(30) Foreign Application Priority Data

Mar. 5, 2001 (JP) ..... 2001-059591

(51) Int. Cl.[7] ..... G03G 15/00; G03G 21/18
(52) U.S. Cl. ..... 399/113; 399/111
(58) Field of Search ..... 399/113, 111, 399/110, 107

(56) References Cited

U.S. PATENT DOCUMENTS

| | | | | |
|---|---|---|---|---|
| 5,095,335 | A | 3/1992 | Watanabe et al. | 399/111 |
| 5,151,734 | A | 9/1992 | Tsuda et al. | 399/111 |
| 5,208,634 | A | 5/1993 | Ikemoto et al. | 399/111 |
| 5,223,893 | A | 6/1993 | Ikemoto et al. | 399/111 |
| 5,294,960 | A | 3/1994 | Nomura et al. | 399/113 |
| 5,331,372 | A | 7/1994 | Tsuda et al. | 399/114 |
| 5,345,294 | A | 9/1994 | Nomura et al. | 399/90 |
| 5,404,198 | A | 4/1995 | Noda et al. | 399/107 |
| 5,455,665 | A | 10/1995 | Baba et al. | 399/358 |
| 5,463,446 | A | 10/1995 | Watanabe et al. | 399/111 |
| 5,465,136 | A | 11/1995 | Watanabe | 399/111 |
| 5,470,635 | A | 11/1995 | Shirai et al. | 428/131 |
| 5,475,470 | A | 12/1995 | Sasago et al. | 399/111 |
| 5,488,459 | A | 1/1996 | Tsuda et al. | 399/167 |
| 5,500,714 | A | 3/1996 | Yashiro et al. | 399/111 |
| 5,510,878 | A | 4/1996 | Noda et al. | 399/111 |
| 5,543,898 | A | 8/1996 | Shishido et al. | 399/111 |
| 5,561,504 | A | 10/1996 | Watanabe et al. | 399/111 |
| 5,583,613 | A | 12/1996 | Kobayashi et al. | 399/111 |
| 5,585,895 | A | 12/1996 | Yashiro et al. | 399/103 |
| 5,602,623 | A | 2/1997 | Nishibata et al. | 399/111 |
| 5,608,509 | A | 3/1997 | Shirai et al. | 399/351 |
| 5,617,579 | A | 4/1997 | Yashiro et al. | 399/114 |
| 5,623,328 | A | 4/1997 | Tsuda et al. | 399/111 |
| 5,640,650 | A | 6/1997 | Watanabe et al. | 399/117 |
| 5,659,847 | A | 8/1997 | Tsuda et al. | 399/113 |
| 5,669,042 | A | 9/1997 | Kobayashi et al. | 399/111 |
| 5,689,774 | A | 11/1997 | Shishido et al. | 399/111 |
| 5,749,027 | A | 5/1998 | Ikemoto et al. | 399/113 |
| 5,768,658 | A | 6/1998 | Watanabe et al. | 399/111 |

(List continued on next page.)

FOREIGN PATENT DOCUMENTS

| | | | |
|---|---|---|---|
| JP | 11-015354 | * | 1/1999 |
| JP | 2001-042753 | * | 2/2001 |

*Primary Examiner*—Sophia S. Chen
(74) *Attorney, Agent, or Firm*—Fitzpatrick, Cella, Harper & Scinto

(57) ABSTRACT

A process cartridge includes: an electrophotographic photosensitive drum; a charging member for charging the drum; a developing member for developing with toner an electrostatic latent image formed on the drum; a first frame supporting the drum and the charging member; a second frame supporting the developing member; a first hole provided in the first frame; a second hole provided in the first frame; a third hole provided in the second frame; a connecting pin extending through the first hole, the second hole, and the third hole to rotatably connect the second frame to the first frame; and a reinforcing portion provided on the downstream side of the first frame with respect to the direction in which the connecting pin is force-fitted so as to restrain deformation of the second hole when force-fitting the connecting pin into the second hole.

18 Claims, 8 Drawing Sheets

U.S. PATENT DOCUMENTS

| | | | | |
|---|---|---|---|---|
| 5,768,660 | A | 6/1998 | Kurihara et al. | 399/111 |
| 5,774,766 | A | 6/1998 | Karakama et al. | 399/111 |
| 5,790,923 | A | 8/1998 | Oguma et al. | 399/106 |
| 5,794,101 | A | 8/1998 | Watanabe et al. | 399/103 |
| 5,809,374 | A | 9/1998 | Tsuda et al. | 399/111 |
| 5,812,909 | A | 9/1998 | Oguma et al. | 399/103 |
| 5,828,928 | A | 10/1998 | Sasago et al. | 399/111 |
| 5,878,304 | A | 3/1999 | Watanabe et al. | 399/92 |
| 5,878,310 | A | 3/1999 | Noda et al. | 399/117 |
| 5,884,124 | A | 3/1999 | Karakama et al. | 399/123 |
| 5,890,036 | A | 3/1999 | Karakama et al. | 399/119 |
| 5,899,602 | A | 5/1999 | Noda et al. | 399/111 |
| 5,903,803 | A | 5/1999 | Kawai et al. | 399/116 |
| 5,920,752 | A | 7/1999 | Karakama et al. | 399/111 |
| 5,937,242 | A | 8/1999 | Yokoyama et al. | 399/114 |
| 5,940,658 | A | 8/1999 | Yokoi et al. | 399/119 |
| 5,943,528 | A | 8/1999 | Akutsu et al. | 399/110 |
| 5,966,566 | A | 10/1999 | Odagawa et al. | 399/109 |
| 5,966,568 | A | 10/1999 | Numagami et al. | 399/111 |
| 6,006,058 | A | 12/1999 | Watanabe et al. | 399/167 |
| 6,016,413 | A | 1/2000 | Yokoyama et al. | 399/113 |
| 6,029,032 | A | 2/2000 | Watanabe et al. | 399/111 |
| 6,032,007 | A | 2/2000 | Yamaji et al. | 399/104 |
| 6,070,028 | A | 5/2000 | Odagawa et al. | 399/104 |
| 6,075,956 | A | 6/2000 | Watanabe et al. | 399/92 |
| 6,097,908 | A | 8/2000 | Uchiyama et al. | 399/111 |
| 6,097,909 | A | 8/2000 | Watanabe et al. | 399/111 |
| 6,101,354 | A | 8/2000 | Nakagawa et al. | 399/225 |
| 6,118,960 | A | 9/2000 | Nakagawa et al. | 399/111 |
| 6,128,454 | A | 10/2000 | Kawai et al. | 399/116 |
| 6,144,398 | A | 11/2000 | Yokoyama et al. | 347/263 |
| 6,144,821 | A | 11/2000 | Oguma | 399/114 |
| 6,160,976 | A | 12/2000 | Karakama et al. | 399/104 |
| 6,163,665 | A | 12/2000 | Watanabe et al. | 399/111 |
| 6,169,866 | B1 | 1/2001 | Watanabe et al. | 399/111 |
| 6,175,706 | B1 | 1/2001 | Watanabe et al. | 399/167 |
| 6,226,478 | B1 | 5/2001 | Watanabe et al. | 399/117 |
| 6,236,821 | B1 | 5/2001 | Yokoyama et al. | 399/113 |
| 6,240,266 | B1 | 5/2001 | Watanabe et al. | 399/117 |
| 6,246,849 | B1 | 6/2001 | Yokoyama et al. | 399/117 |
| 6,253,036 | B1 | 6/2001 | Karakama et al. | 399/27 |
| 6,266,500 | B1 | 7/2001 | Numagami et al. | 399/104 |
| 6,272,299 | B1 | 8/2001 | Numagami et al. | 399/111 |
| 6,324,363 | B1 | 11/2001 | Watanabe et al. | 399/111 |
| 6,330,402 | B1 | 12/2001 | Sakurai et al. | 399/12 |
| 6,330,409 | B1 | 12/2001 | Watanabe et al. | 399/111 |
| 6,336,018 | B1 | 1/2002 | Kawai et al. | 399/117 |

* cited by examiner

PROCESS CARTRIDGE AND ELECTROPHOTOGRAPHIC IMAGE FORMING APPARATUS

BACKGROUND OF THE INVENTION

1. Field of the Invention

The present invention relates to a process cartridge and an electrophotographic image forming apparatus.

An electrophotographic image forming apparatus forms images on recording media by using an electrophotographic image forming process. Examples of an electrophotographic image forming apparatus include an electrophotographic copying machine, an electrophotographic printer (such as a laser beam printer and an LED printer), a facsimile apparatus, and a word processor.

A process cartridge is realized by forming at least a charging means, a developing means, and an electrophotographic photosensitive drum into an integral cartridge unit, which is detachably mountable to an image forming apparatus main body. Further, at least a charging means, a developing means, a cleaning means as a process means, and an electrophotographic photosensitive drum are formed into an integral cartridge unit, which is detachably mountable to an image forming apparatus main body.

2. Description of Related Art

In an electrophotographic image forming apparatus using the electrophotographic image forming process, selective exposure corresponding to image information is performed on an electrophotographic photosensitive member uniformly charged by a charging means to thereby form a latent image.

Then, the latent image is developed by a developing means using toner to form a toner image. Thereafter, the toner image formed on the electrophotographic photosensitive member is transferred to a recording medium by a transferring means to thereby effect image formation.

Conventionally, in an image forming apparatus using an electrophotographic image forming process, a process cartridge system is adopted, in which a drum-shaped electrophotographic photosensitive member and a process means acting on the electrophotographic photosensitive member are formed into an integral cartridge, which is detachably mountable to an image forming apparatus main body. In this process cartridge system, the maintenance of the apparatus can be performed by the user without having to rely on a serviceman, whereby a substantial improvement is achieved in terms of operability. Thus, the process cartridge system is widely used in image forming apparatuses.

In a typical construction of such a process cartridge, two frames are joined together. For example, a cleaning frame (first frame) supporting a photosensitive drum, a charger, and a cleaning device and a frame (second frame) formed by connecting together a developing frame supporting a developing means and a toner frame having a toner chamber, are joined together so as to be rotatable around a fulcrum. Then, the two frames are urged around the fulcrum by an elastic member such as a spring to determine the positional relationship between the photosensitive drum and the developing means. The above-described construction is advantageous, for example, in that the pressure force of the developing roller on the photosensitive drum is made appropriate and that a gap is maintained between the photosensitive drum surface and the developing roller surface. Other advantages of this construction include facilitation of the frame formation due to the two-piece frame structure and facilitation of the assembly. In the present invention, the advantages of the above-described conventional technique are further enhanced.

SUMMARY OF THE INVENTION

It is an object of the present invention to provide a process cartridge comprising a first frame and a second frame, in which, when a connecting pin for connecting the first frame and the second frame is force-fitted, it is possible to prevent a reduction in the fastening force of the connecting pin due to deformation to enlarge the diameter of the hole into which the connecting pin is force-fitted.

Another object of the present invention is to provide a process cartridge comprising a first frame and a second frame, in which, when a connecting pin for connecting the first frame and the second frame is force-fitted, it is possible to prevent deformation of a charging member support portion supporting a charging member, making it possible to press the charging member against the photosensitive drum in a stable manner.

Still another object of the present invention is to provide a process cartridge in which, when a connecting pin for connecting the first frame and the second frame is force-fitted, it is possible to prevent a reduction in the fastening force of the connecting pin due to deformation to enlarge the diameter of the hole into which the connecting pin is force-fitted, and it is possible to prevent deformation of a charging member support portion supporting a charging member, making it possible to press the charging member against the photosensitive drum in a stable manner.

Also, another object of the present invention is to provide an image forming apparatus and a process cartridge detachably attachable to a main body of an electrophotographic image forming apparatus including: an electrophotographic photosensitive drum; a charging member for charging the electrophotographic photosensitive drum; a developing member for developing with toner an electrostatic latent image formed on the electrophotographic photosensitive drum; a first frame supporting the electrophotographic photosensitive drum and the charging member; a second frame supporting the developing member; a first hole provided in the first frame; a second hole provided in the first frame; a third hole provided in the second frame; a connecting pin passed through the first hole, the second hole, and the third hole to rotatably connect the second frame to the first frame; and a reinforcing portion provided on the downstream side of the first frame with respect to the direction in which the connecting pin is force-fitted so as to restrain deformation of the second hole when force-fitting the connecting pin into the second hole.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Embodiments of the present invention will now be described in detail with reference to the drawings.

A preferred embodiment of the present invention will be described. In the following description, the transverse direction of a process cartridge B is the direction in which the process cartridge B is mounted to and detached from an apparatus main body 14, and aligned with the direction in which the recording medium is conveyed. The longitudinal direction of the process cartridge B is a direction crossing (substantially perpendicular to) the direction in which the process cartridge B is mounted to and detached from the apparatus main body 14. It is a direction parallel to the surface of the recording medium and crossing (substantially perpendicular to) the direction in which the recording medium is conveyed. When it is said that something is on the right-hand or left-hand side of the process cartridge, it is on the right-hand or left-hand side of the recording medium conveying route as seen from above.

Figure 3:
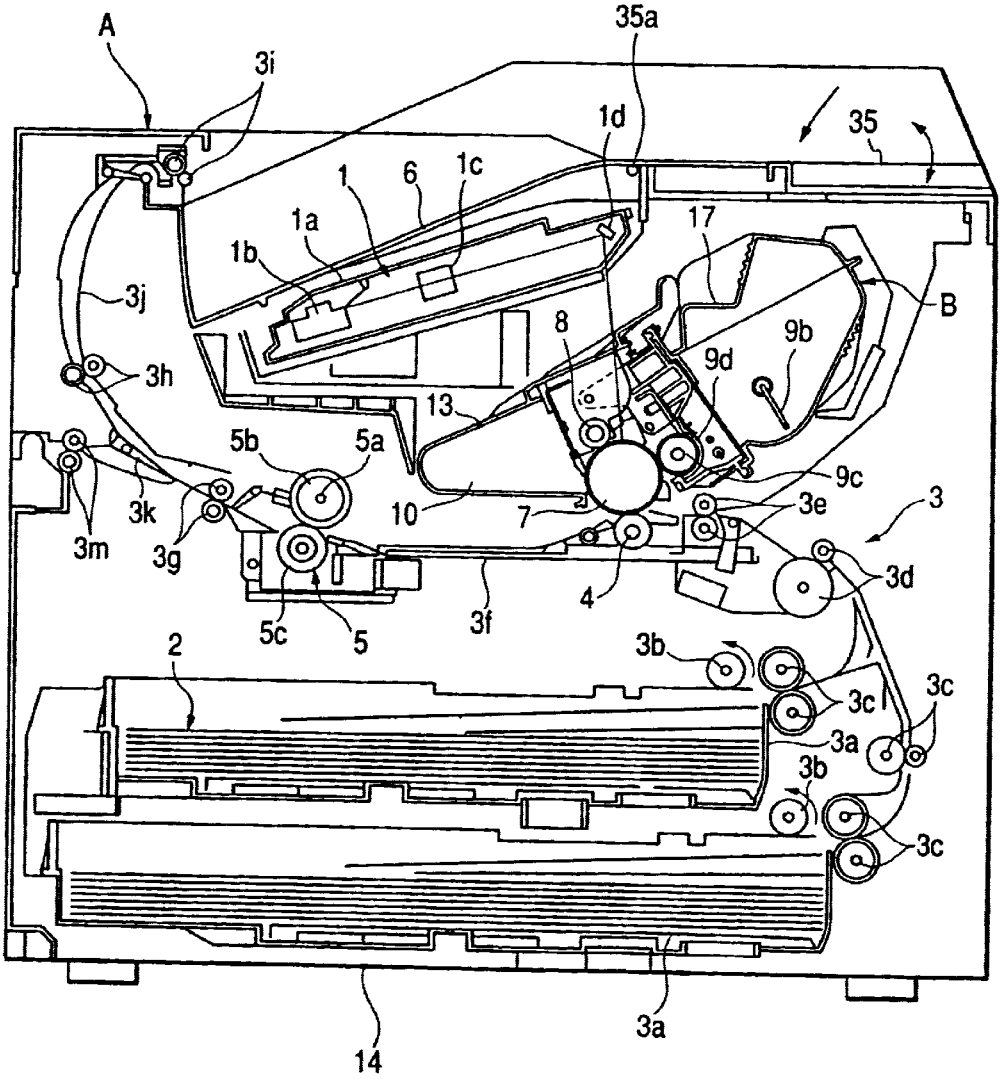
FIG. 3 is a vertical sectional view of an image forming apparatus main body according to an embodiment of the present invention.
Figure 4:
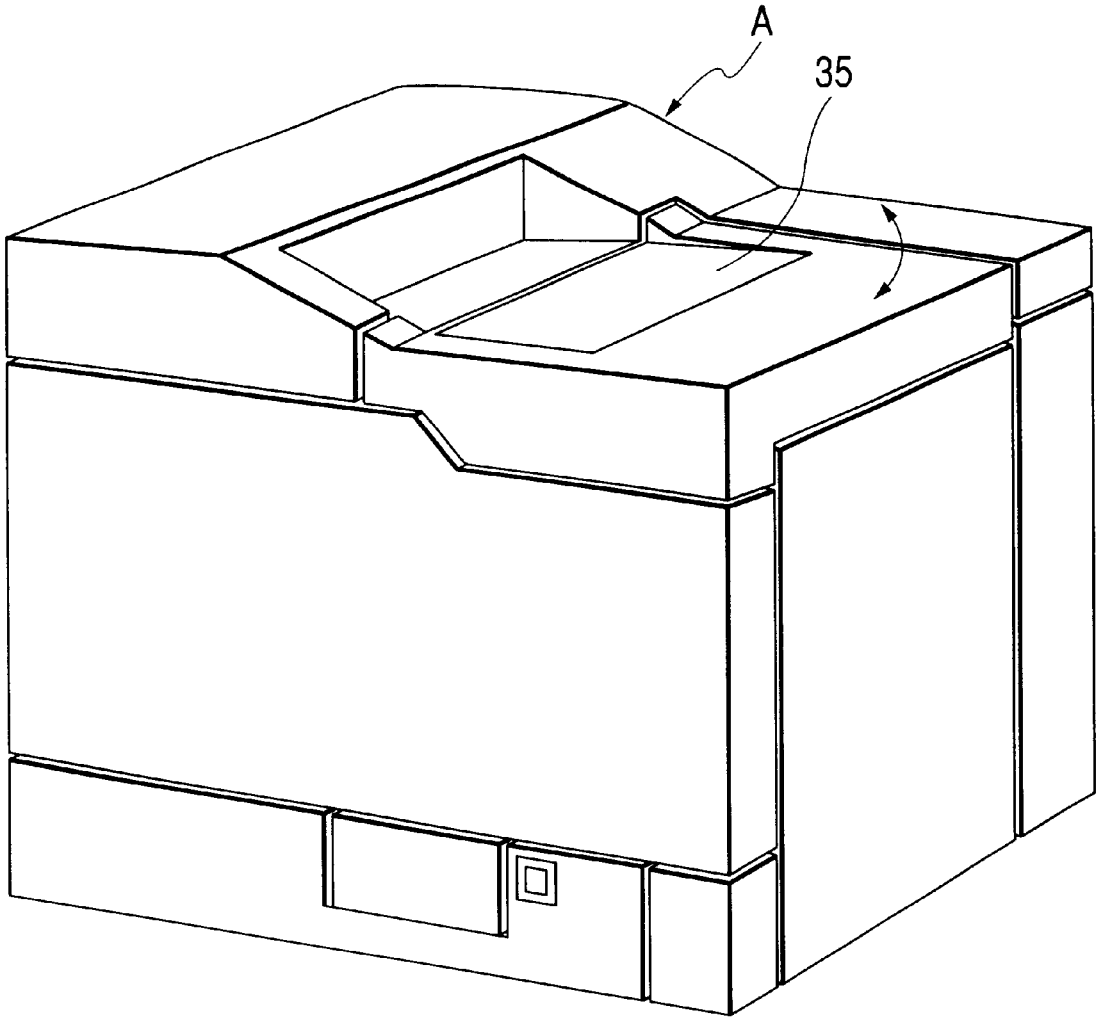
FIG. 4 is an outward perspective view of an image forming apparatus main body according to an embodiment of the present invention.

FIG. 3 is a diagram illustrating the construction of an electrophotographic image forming apparatus (laser beam printer) to which an embodiment of the present invention is applied, and FIG. 4 is an outward perspective view thereof. FIGS. 5 through 8 are diagrams showing a process cartridge to which an embodiment of the present invention is applied. In the following description, the upper surface of the process cartridge B is the surface situated on the upper side when the process cartridge B is mounted to the apparatus main body 14, and the lower surface is the surface situated on the lower side then.

Electrophotographic Image Forming Apparatus A and Process Cartridge B

Figure 5:
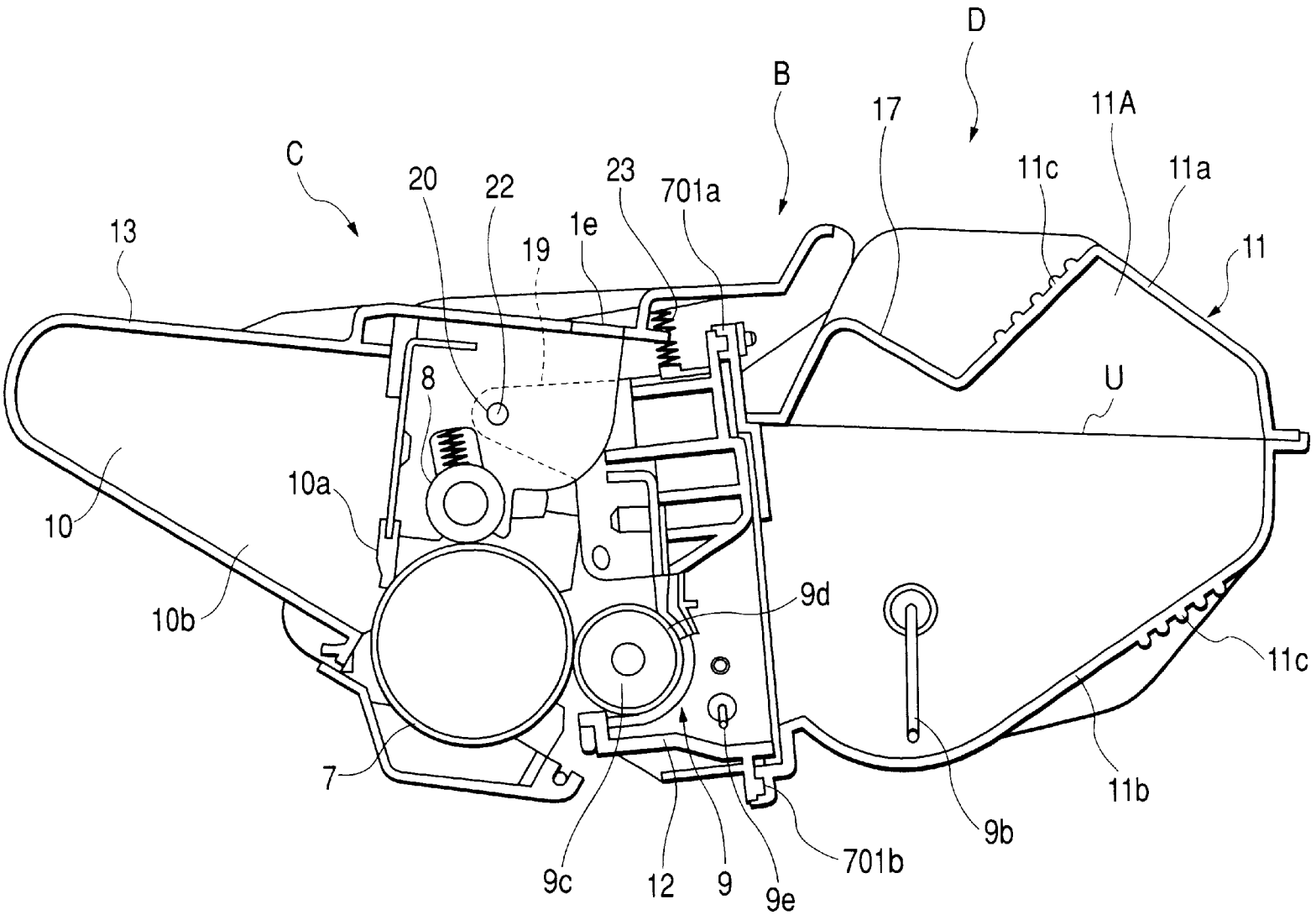
FIG. 5 is a vertical sectional view of a process cartridge according to an embodiment of the present invention.

First, with reference to FIGS. 3 and 4, a laser beam printer A as an electrophotographic image forming apparatus to which an embodiment of the present invention is applied will be described. FIG. 5 is a side sectional view of the process cartridge B.

As shown in FIG. 3, the laser beam printer A forms an image on a recording medium (e.g., recording paper sheet, OHP sheet, or cloth) by an electrophotographic image forming process. Then, a toner image is formed on a drum-shaped electrophotographic photosensitive member (hereinafter referred to as a photosensitive drum). More specifically, charging is performed on the photosensitive drum by a charging means. Then, a laser beam according to image information irradiates the photosensitive drum from an optical means to form an electrostatic latent image according to the image information on the photosensitive drum. And, the latent image is developed by a developing means to form a toner image. Then, in synchronism with the formation of the toner image, a recording medium 2 in a feed cassette 3*a* is turned over and conveyed by a pick-up roller 3*b*, conveyance roller pairs 3*c* and 3*d*, and a registration roller pair 3*e*. Then, the toner image formed on the photosensitive drum 7 of the process cartridge B is transferred to the recording medium 2 by applying voltage to a transferring roller 4 as a transferring means. Thereafter, the recording medium 2 to which the toner image has been transferred is conveyed to a fixing means 5 along a conveyance guide 3*f*. The fixing means 5 has a driving roller 5*c* and a fixing roller 5*b* with a built-in heater 5*a*. And, heat and pressure are applied to the passing recording medium 2 to thereby fix the transferred toner image. The recording medium 2 is conveyed by delivery roller pairs 3*g*, 3*h*, and 3*i*, and delivered to a delivery tray 6 through a turn-over passage 3*j*. The delivery tray 6 is provided on the upper surface of the main body 14 of the image forming apparatus A. It is also possible to operate a swingable flapper 3*k* and deliver the recording medium 2 by a delivery roller pair 3*m* without passing it through the turn-over passage 3*j*. In the embodiment, the conveying means 3 is formed by the pick-up roller 3*b*, the conveyance roller pairs 3*c* and 3*d*, the registration roller pair 3*e*, the conveyance guide 3*f*, the delivery roller pairs 3*g*, 3*h*, and 3*i*, and the delivery roller pair 3*m*.

As shown in FIGS. 3 and 5, in the process cartridge B, the photosensitive drum 7 is rotated, and its surface is uniformly charged by applying voltage to a charging roller 8 serving as the charging means. Then, a laser beam in accordance with image information from an optical system 1 irradiates the photosensitive drum 7 through an exposure opening 1*e* to form a latent image. Then, the latent image is developed by a developing means 9 using a toner. That is, the charging roller 8 is provided so as to be in contact with the photosensitive drum 7, and performs charging on the photosensitive drum 7. The charging roller 8 is driven by the photosensitive drum 7 to rotate. The developing means 9 supplies toner to a developing region of the photosensitive drum 7 to develop the latent image formed on the photosensitive drum 7. The optical system 1 has a laser diode 1*a*, a polygon mirror 1*b*, a lens 1*c*, and a reflection mirror 1*d*.

The developing means 9 sends out toner in a toner container 11A to a developing roller 9*c* through rotation of a toner feeding member 9*b*. Then, the developing roller 9*c* with a built-in stationary magnet is rotated, and a toner layer with induced triboelectrification charge is formed on the surface of the developing roller 9*c* by a developing blade 9*d*, the toner being supplied to the developing region of the photosensitive drum 7. Further, by transferring the toner to the photosensitive drum 7 in conformity with the latent image, a toner image is formed, thus visualizing the latent image. The developing blade 9*d* regulates the amount of toner on the peripheral surface of the developing roller 9*c*, and gives triboelectrification charge to the toner (induces triboelectrification charge in the toner). In the vicinity of the developing roller 9*c*, a toner agitating member 9*e* for circulating the toner in the developing chamber is rotatably attached.

A voltage of a polarity opposite to that of the toner image is applied to the transferring roller 4 to transfer the toner image formed on the photosensitive drum 7 to the recording medium 2, and then the residual toner on the photosensitive drum 7 is removed by a cleaning means 10. The cleaning means 10 scrapes off the residual toner on the photosensitive drum 7 by an elastic cleaning blade 10*a* provided so as to abut against the photosensitive drum 7, and collects the toner in a removed toner reservoir 10*b*.

Figure 6:
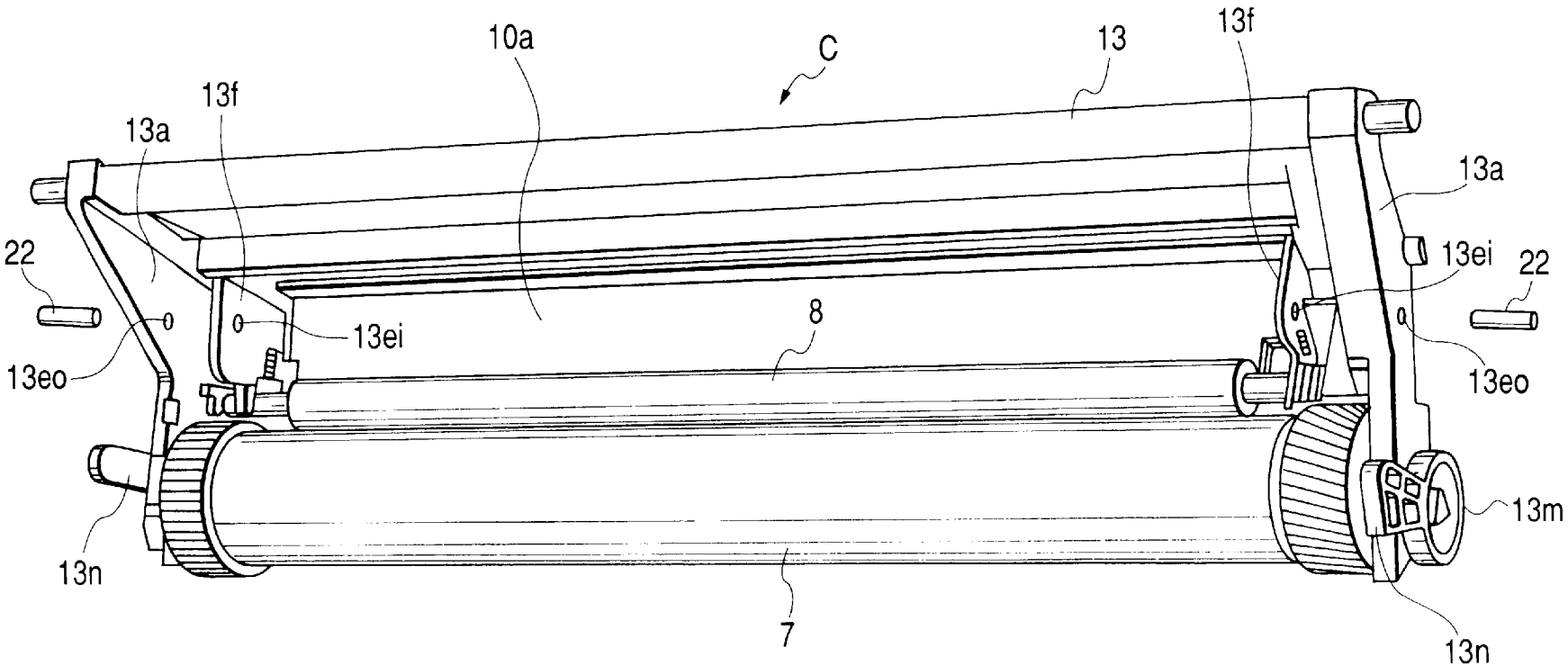
FIG. 6 is a perspective view showing a cleaning unit according to an embodiment of the present invention.

When an opening/closing member 35 provided in the upper right portion of the apparatus main body 14 shown in FIG. 3 is opened by using a hinge 35*a* as a fulcrum, there becomes visible on either side of the upper right portion of the apparatus main body 14 a guide rail (not shown) provided so as to extend obliquely downwards to the left. As shown in FIG. 6, in the central line of the photosensitive drum 7 of the process cartridge B, there are provided on each side a rounded guide 13*m* to be fitted into a positioning groove provided at a terminal end of the guide rail and a long, ridge-shaped positioning guide 13*n* integral with or spaced apart from the rounded guide 13*m* and adapted to be engaged with the guide rail. The rounded guides 13*m* and the positioning guides 13*n* are inserted into the guide rail to attach the process cartridge B to the apparatus main body 14.

When detaching the process cartridge B from the apparatus main body 14, it is pulled upwardly obliquely to the right.

When mounting or detaching the process cartridge B, the hand is applied to ridges 11*c* in a recess 17 of an upper frame 11*a* and to ridges 11*c* of a lower frame 11*b*. The toner frame 11 is formed as an integral unit by welding the upper frame 11*a* and the lower frame 11*b* to each other at the connection surface U.

Process Cartridge Frame Construction

In the process cartridge B of the embodiment, a developing unit D in which the toner frame (second frame) 11 having the toner container (toner containing portion) 11A for containing toner and a developing frame (second frame) 12 holding the developing means 9 such as the developing roller 9*c* are welded together at positions designated by the reference signs 701*a* and 701*b*, and a cleaning unit C in which the photosensitive drum 7, the cleaning means 10 such as the cleaning blade 10*a*, and the charging roller 8 are attached to the cleaning frame (first frame) 13, are connected together so as to be rotatable using a connecting pin 22 as a fulcrum. Further, as shown in FIG. 2, the end portions of a compression coil spring 23 are respectively fitted onto a bar-shaped spring bracket 13*b* of the cleaning frame 13 and a bar-shaped spring bracket 12*a* of the developing frame 12 to compress the spring, and the cleaning frame 13 is biased counterclockwise, and the developing frame 12 is biased clockwise around hanging holes 20, bringing the photosensitive drum 7 and spacer runners 9*i* at both ends of the developing roller 9*c* into press contact with each other.

Method of Connecting Cleaning Frame and Developing Frame

FIGS. 1, 2, 6, 7, and 8 show how the cleaning unit C and the developing unit D are connected to each other. FIG. 6 shows the cleaning frame 13 and the connecting pin 22.

Figure 2:
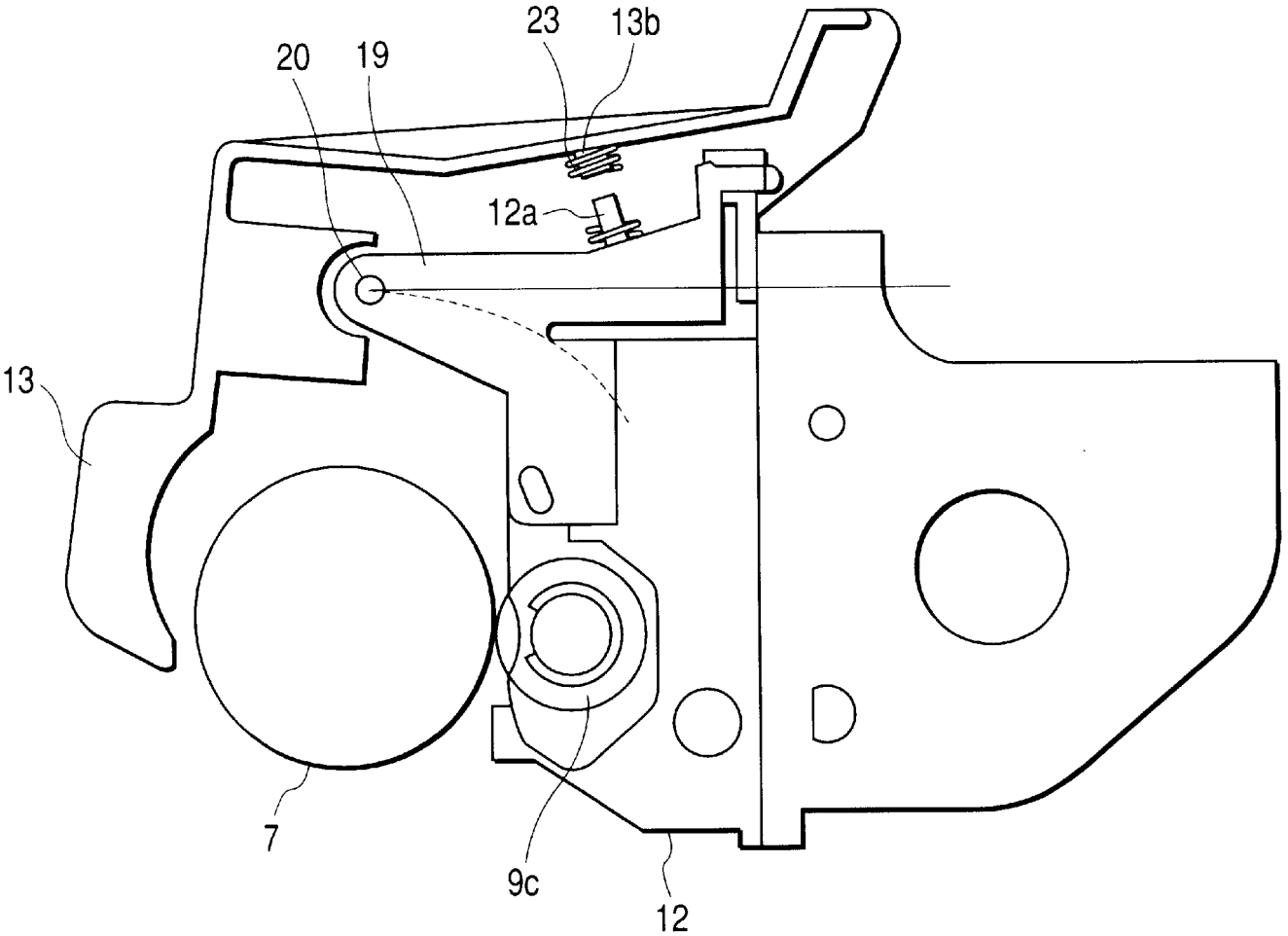
FIG. 2 is a vertical sectional view showing the construction of a process cartridge frame connecting portion.
Figure 7:
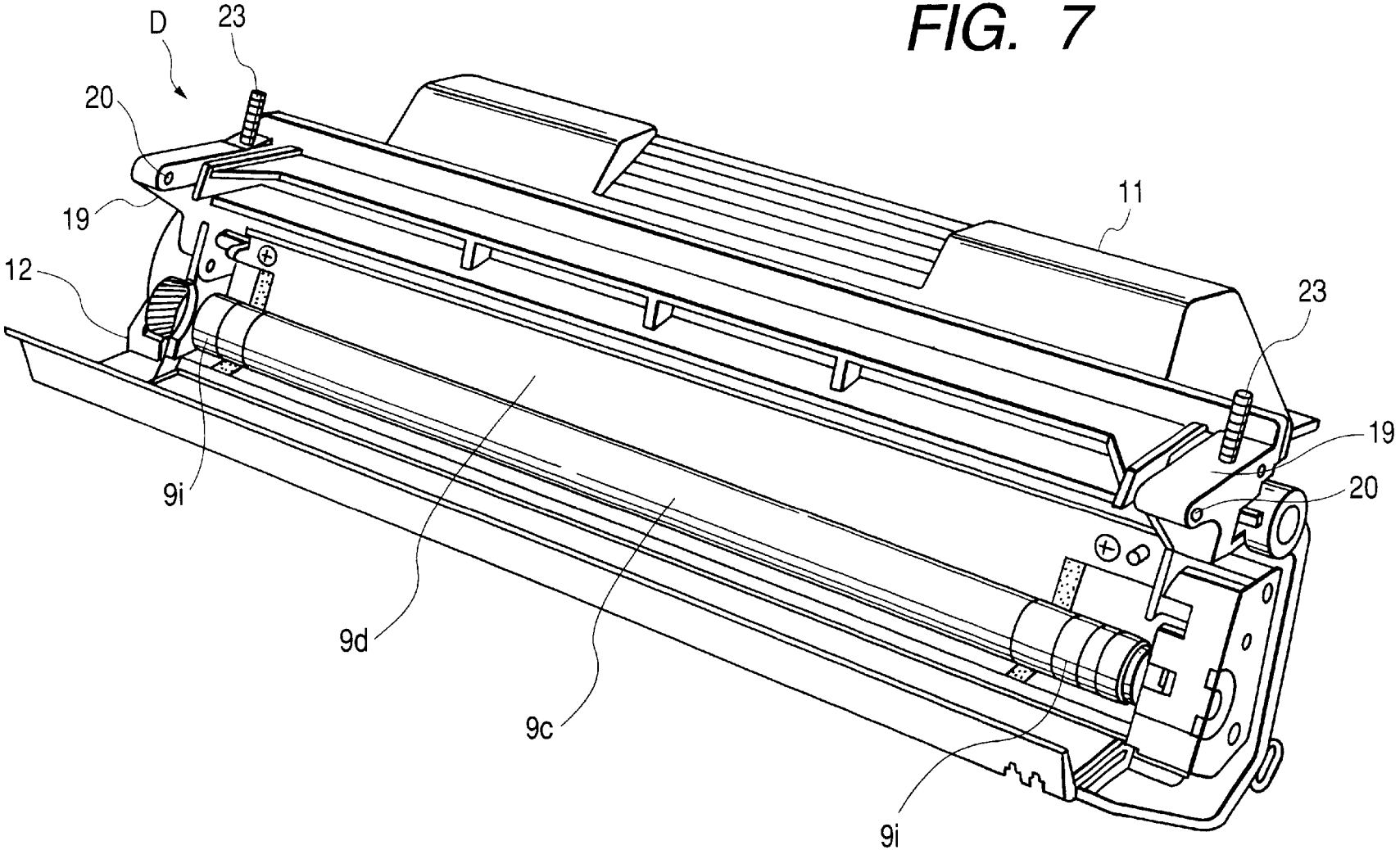
FIG. 7 is a perspective view showing a developing unit according to an embodiment of the present invention.
Figure 8:
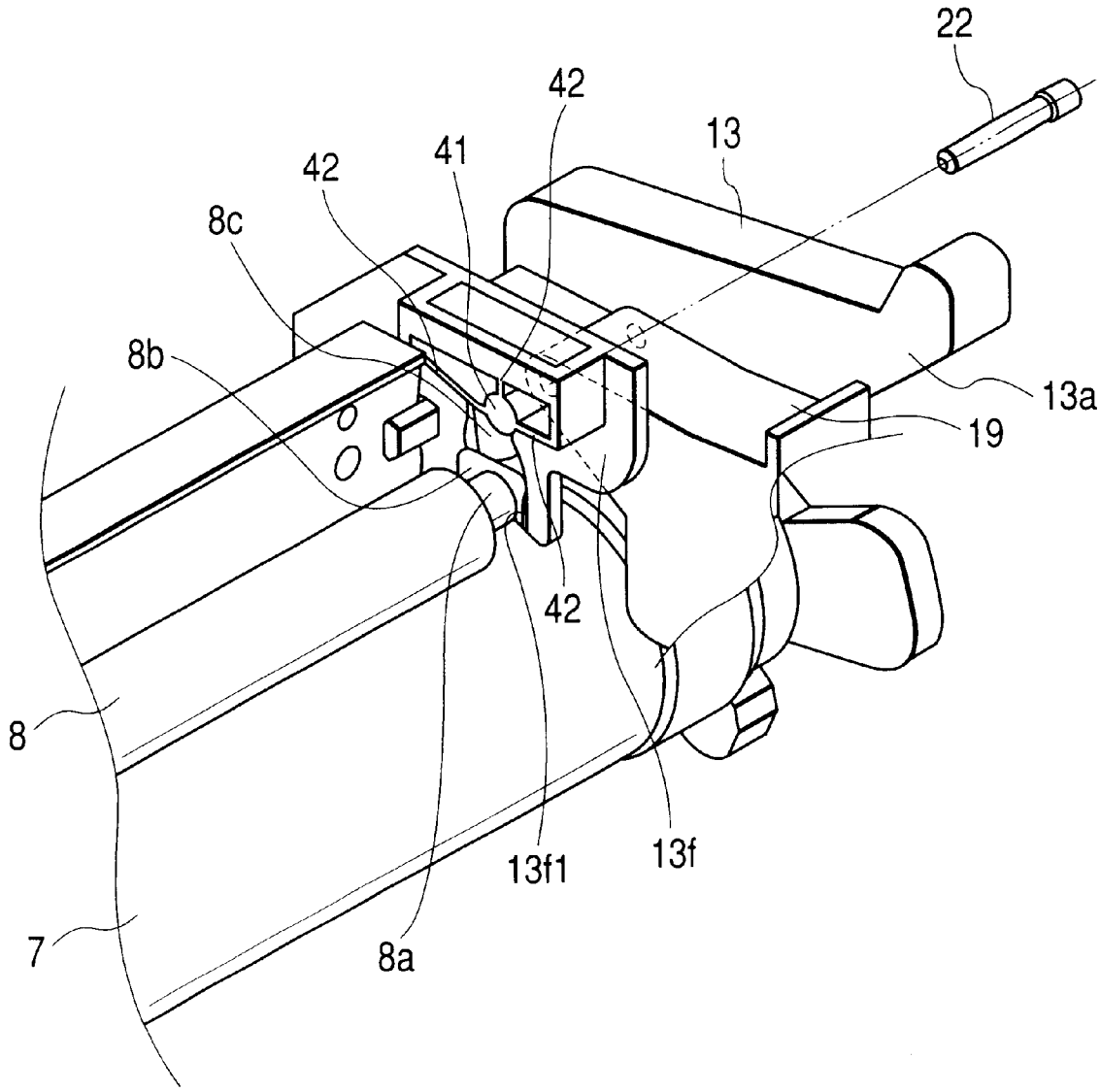
FIG. 8 is a perspective view showing a frame connecting portion according to Embodiment 1 of the present invention.

As shown in FIGS. 2, 7, and 8, at the longitudinal ends of the developing frame 12, arm portions 19 protrude toward the cleaning frame 13. At the forward ends of the two arm portions 19 of the developing frame 12, the hanging holes 20 are provided coaxially. In an outer longitudinal side plate 13*a* of the cleaning frame 13, a hole 13*eo* (first hole) is provided. Then, on the inner side of the outer side plate 13*a*, there is arranged an inner side plate 13*f* for supporting the charging roller 8 with a space a little larger than the width of the arm portion 19. Further, in the inner side plate 13*f*, there is provided a blind hole 13*ei* (second hole). The hole 13*eo* and the blind hole 13*ei* are in a longitudinal straight line, and parallel to the photosensitive drum 7. The diameter of the hole 13*eo* is larger than the diameter of the blind hole 13*ei*. Further, as described below, in the blind hole 13*ei* portion, there are provided an air hole 41 and reinforcing ribs 42.

Figure 1:
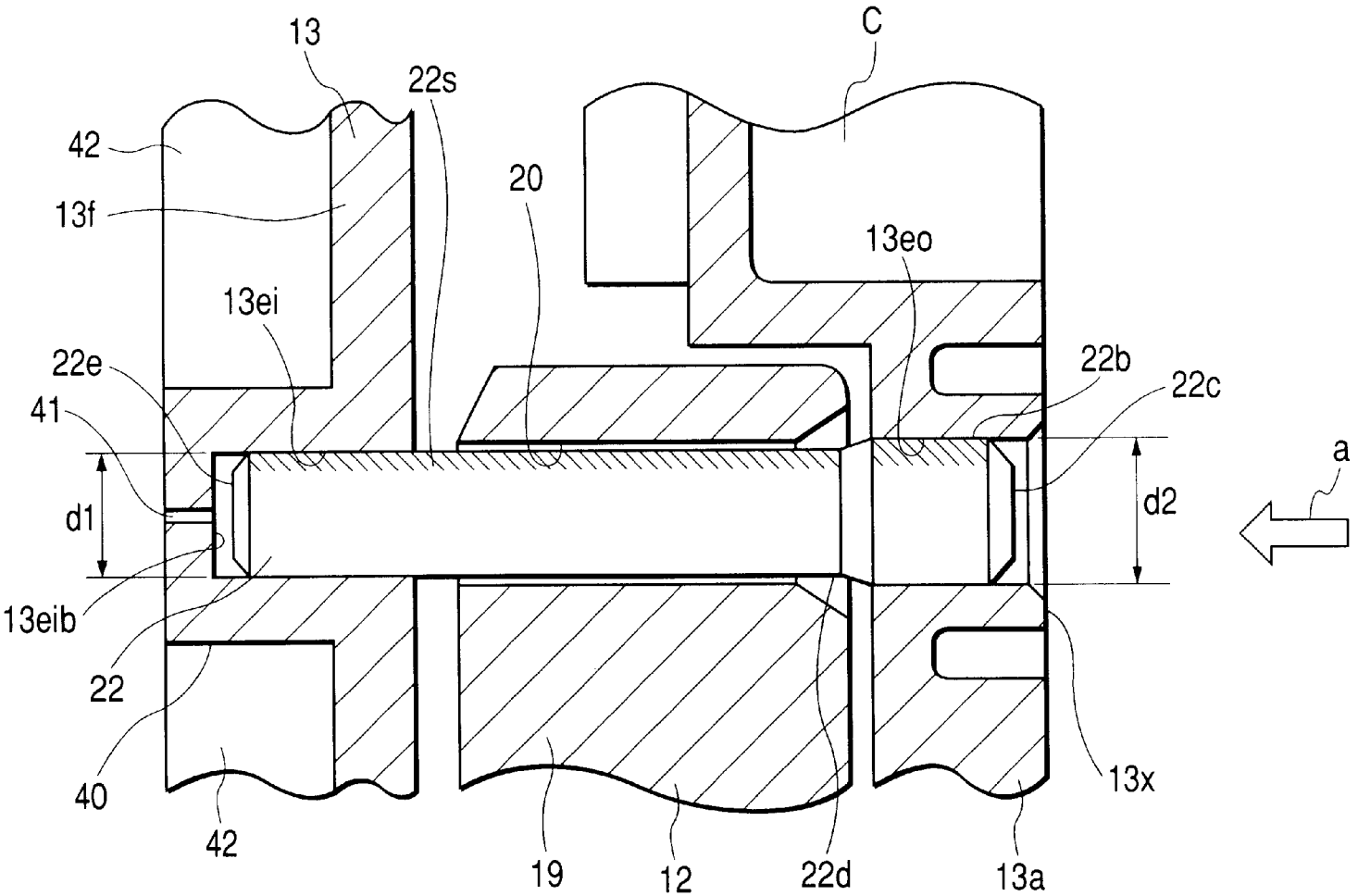
FIG. 1 is a sectional view of a frame connecting portion according to Embodiment 1 of the present invention, taken along a substantially horizontal line.

As shown in FIG. 1, the blind hole 13*ei* is provided at the center of a cylindrical portion 40 integral with the inner side plate 13*f*. Further, as shown in FIG. 8, the ribs 42 are radially connected to the outer periphery of the cylindrical portion 40. In this example, the number of ribs 42 is three. Further, the ribs 42 are provided on the downstream side of the inner side plate 13*f* with respect to the direction in which the connecting pin 22 is force-fitted, whereby deformation, e.g., falling, of the inner side plate 13*f* due to the force-fitting of the connecting pin 22 is prevented. As shown in FIG. 8, the inner side plate 13*f* has a pair of parallel bearing guides 13*f*1 extending on both sides of the straight line passing through the center of the photosensitive drum 7, and a charging roller bearing 8*b* is movably engaged with these guides 13*f*1. The charging roller bearing 8*b* and the core 8*a* of the charging roller 8 are rotatably supported. A compression coil spring 8*c* is provided in a compressed state between the charging roller bearing 8*b* and the base of the bearing guides 13*f*1, whereby the charging roller 8 is held in press contact with the photosensitive drum 7.

When connecting the cleaning frame 13 and the developing frame 12 with each other, the arm portions 19 of the developing frame 12 of the cleaning frame 13 are inserted between the outer side plates 13*a* and the inner side plates 13*f* of the cleaning frame 13, and positioning is effected such that the support hole portions 13*e* (13*ei*, 13*eo*) and the hanging holes 20 (third hole) of the developing frame 12 are arranged substantially coaxially before force-fitting the connecting pins 22 from the outer side of the side surfaces of the cleaning frame 13. The engagement between the outer peripheral portions of the connecting pins 22 and the inner peripheries of the support holes 13*e* (13*eo*, 13*ei*) of the cleaning frame 13 is effected through interference fit, and the engagement between the outer peripheral portions of the connecting pins 22 and the inner peripheries of the hanging holes 20 of the developing frame 12 is effected through running fit. Thus, when the connecting pins 22 have been force-fitted and the assembly has been completed, the developing frame 12 is supported so as to be rotatable around the connecting pins 22, and, at the same time, the connecting pins 22 are engaged with the cleaning frame 13 with a strength large enough to withstand a pulling load of a fixed level or more.

FIG. 1 is a sectional view showing in detail the connection structure through the connecting pins.

The connecting pins 22 are pins of steel such as stainless steel or a non-ferrous metal such as brass formed by machining, grinding, or cold forming. Each of them has a small diameter portion 22*s* (of a diameter d1) and a large diameter portion 22*b* (of a diameter d2), and a step portion 22*d* therebetween is formed as a tapered portion. In FIG. 1, the arrow "a" indicates the direction in which the connecting pin 22 is inserted. In the state shown in FIG. 1, the assembly has been completed. That is, the connecting pin 22 is inserted inwardly from the outer side of the side surface of the cleaning frame 13.

In this embodiment, the diameter d1 of the small diameter portion 22*s* of the connecting pin 22 is Ø (Phi) 3.0 (tolerance: 0 at the maximum, −0.0015 at the minimum), the diameter d2 of the large diameter portion 22*b* is Ø3.5 (JIS standard m8; tolerance: +0.22 at the maximum, +0.004 at the minimum), the inner diameter of the blind hole 13*ei* is Ø3.0 (tolerance: −0.040 at the maximum, −0.065 at the minimum), the inner diameter of the hole 13*eo* is Ø3.5 (tolerance: −0.030 at the maximum, −0.060 at the minimum), and the inner diameter of the hanging hole 20 is Ø3.0 (JIS standard E8; tolerance: +0.028 at the maximum, +0.014 at the minimum) (All of the above dimensions are in millimeter).

As a result, when engaging the connecting pin 22 with the cleaning frame 13, the engagement between the connecting pin small diameter portion 22*s* and the support hole 13*ei* and the engagement between the connecting pin larger diameter portion 22*b* and the support hole 13*eo* are effected through interference fit, the pin being force-fitted and engaged. The engagement between the connecting pin small diameter portion 22*s* and the developing frame hanging hole 20 is effected through running fit, so that the developing frame 12 is connected so as to be rotatable around the connecting pin 22. In this connecting method, force-fitting and engagement is effected at two portions between the cleaning frame 13 and the connecting pin 22, so that the drag against the pin pulling force increases, thereby effecting connection reliably and firmly.

In the present construction, the step portion 22*d* of the connecting pin 22 was pressurized and the force with which the connecting pin 22 is pulled out was measured and found to be approximately 5 kgf, which is large enough to prevent the pin from coming off during use of the process cartridge B.

As shown in FIG. 1, when the force-fitting of the connecting pin 22 has been completed, the end surface 22*c* of the connecting pin 22 is retracted from a pin insertion end surface 13*x* of the cleaning frame 13. With this arrangement, the user is prevented from inadvertently pulling out the connecting pin 22 to separate the cleaning unit C and the developing unit D from each other.

Blind Hole Structure of Support Hole

The blind hole construction of the support hole 13*ei* will be described in detail with reference to the sectional view of FIG. 1 and the detailed perspective view of FIG. 8.

The support hole 13*ei* of the inner side plate 13*f* is formed as a blind hole extending toward the inner side of the cleaning frame 13. Chips generated from the connecting pin 22 when force-fitting the connecting pin 22 into the support hole 13*ei* for engagement to connect the cleaning frame 13 and the developing frame 12 to each other are prevented from falling in the cleaning frame 13 or the developing frame 12 from the force-fit portion, making it unnecessary to perform any special cleaning operation to remove the chips generated.

The connecting pin 22 does not reach the bottom surface 13*eib* of the blind hole 13*ei*, and there is a gap between the bottom surface 13*eib* and the end surface 22*e* of the connecting pin 22.

A minute air hole 41 of approximately Ø0.1 to 1 mm extends through the bottom surface 13*eib* of the blind hole 13*ei*, whereby, when force-fitting the connecting pin 22 for engagement, the air inside the blind hole 13*ei* is prevented from being compressed to generate a force to detach the connecting pin 22; after the force-fit engagement, the pressure of the air inside the blind hole 13*ei* is prevented from rising due to a temperature change to generate a force to detach the connecting pin 22.

It is more preferable for the air hole 41 to be as small as possible in diameter since that will prevent minute chips from falling. Further, to prevent chips from falling, it is preferable for the air hole 41 to be situated above the horizontal line passing the hole center (at the time of insertion of the process cartridge into the main body).

Reinforcing ribs 42 are provided on that side of the inner side plate 13*f* for supporting the charging roller 8 and the blind hole 13*ei* which is opposite to the force-fitting side. With the provision of the ribs 42, it is possible to prevent the inner side plate 13*f* supporting the blind hole 13*ei* from falling during molding. Further, when force-fitting the connecting pin 22 for engagement, the inner side plate 13*f* is prevented from undergoing deformation (e.g., falling) in the force-fitting direction, whereby it is possible to prevent a reduction in the pressure force for the charging roller 8 which would cause defective charging. Further, by connecting the reinforcing ribs 42 to the outer periphery of the blind hole 13*ei*, when force-fitting the connecting pin 22 for engagement, the hole 13*ei* is prevented from being deformed to undergo an increase in diameter to extremely deteriorate the strength (fastening force) with which to avoid detachment.

As described above, in accordance with the embodiment, in a process cartridge composed of two frames (cleaning frame C and developing frame D), there are provided reinforcing ribs 42 for restraining deformation of the hole 13*ei* into which the connecting pin 22 for connecting together the two frames, whereby it is possible to prevent the hole 13*ei* from undergoing deformation to increase in diameter, thereby preventing a deterioration of the strength of the connecting pin 22 with which to avoid detachment. Further, deformation (e.g., falling) of the charging roller bearing 8*b* when force-fitting the connecting pin 22 is prevented, whereby the charging roller 8 can be pressed against the photosensitive drum 7 in a stable manner.

As described above, in accordance with the present invention, there is provided a process cartridge composed of a first frame and a second frame, in which, when force-fitting a connecting pin for connecting together the first frame and the second frame, it is possible to prevent deformation of the hole into which the connecting pin is force-fitted to increase in diameter to make the connecting pin easily detachable, whereby it is possible to prevent a deterioration in the fastening force obtained by the connecting pin, thereby realizing a reliable and strong connection.

Further, when force-fitting the connecting pin, it is also possible to prevent deformation of a charging member support portion supporting the charging member, thereby making it possible to press the charging member against the photosensitive drum in a stable manner.

While the invention has been described with reference to the structure disclosed herein, it is not confined to the details set forth and this application is intended to cover such modifications or changes as may come within the purposes of the improvements or the scope of the following claims.

What is claimed is:

1. A process cartridge detachably mountable to a main body of an electrophotographic image forming apparatus, said process cartridge comprising:

an electrophotographic photosensitive drum;

a charging member configured and positioned to charge said electrophotographic photosensitive drum;

a developing member configured and positioned to develop with toner an electrostatic latent image formed on said electrophotographic photosensitive drum;

a first frame supporting said electrophotographic photosensitive drum and said charging member;

a second frame supporting said developing member;

a first hole provided in said first frame;

a second hole provided in said first frame;

a third hole provided in said second frame;

a connecting pin extending through said first hole, said second hole, and said third hole to rotatably connect said second frame to said first frame by being force-fitted into said second hole; and a reinforcing portion provided on a downstream side of said first frame with respect to a direction in which said connecting pin is force-fitted so as to restrain deformation of said second hole when force-fitting said connecting pin into said second hole, wherein said second hole is formed in a cylindrical portion provided in said first frame.

2. A process cartridge according to claim 1, wherein said reinforcing portion is provided on an outer side of said cylindrical portion.

3. A process cartridge according to claim 1, wherein said reinforcing portion is provided radially on an outer side of said cylindrical portion.

4. A process cartridge according to claim 3, further comprising at least one additional reinforcing portion.

5. A process cartridge according to claim 1, wherein said reinforcing portion connects a charging member support portion supporting said charging member provided in said first frame to said cylindrical portion.

6. A process cartridge according to claim 5, wherein said reinforcing portion, said charging member support portion, and said cylindrical portion provided in said first frame are integrally formed.

7. A process cartridge according to claim 1, wherein said first hole is provided in an outer side plate provided at an axial end of said electrophotographic photosensitive drum of said first frame, and wherein said second hole is provided in an inner side plate provided on said first frame which is located on an inside side of said outer side plate and is spaced apart from said outer side plate by a predetermined distance.

8. A process cartridge according to claim 7, wherein said third hole is provided in an arm portion protruding from said second frame and inserted between said outer side plate and said inner side plate.

9. A process cartridge according to claim 1, wherein one end of said connecting pin is supported by said first hole, and wherein the other end of said connecting pin is supported by said second hole.

10. A process cartridge according to any one of claims 1 to 9, wherein said reinforcing portion is in a form of a rib.

11. A process cartridge detachably mountable to a main body of an electrophotographic image forming apparatus, said process cartridge comprising:

an electrophotographic photosensitive drum;

a charging member configured and positioned to charge said electrophotographic photosensitive drum;

a developing member configured and positioned to develop with toner an electrostatic latent image formed on said electrophotographic photosensitive drum;

a first frame supporting said electrophotographic photosensitive drum and said charging member;

a second frame supporting said developing member;

an outer side plate provided at an axial end of said electrophotographic photosensitive drum provided in said first frame;

an inner side plate provided on said first frame and being located on an inside side of said outer side plate and being spaced apart from said outer side plate by a predetermined distance;

an arm portion protruding from said second frame and inserted between said outer side plate and said inner side plate;

a first hole provided in said outer side plate;

a second hole provided in said inner side plate;

a third hole provided in said arm portion;

a charging member support portion provided in said inner side plate configured and positioned to support said charging member;

a connecting pin extending through said first hole, said second hole, and said third hole to rotatably connect said second frame to said first frame by being force-fitted into said second hole; and a reinforcing portion provided on a downstream side of said inner side plate with respect to a direction in which said connecting pin is force-fitted so as to restrain deformation of said second hole when force-fitting said connecting pin into said second hole, wherein said second hole is formed in a cylindrical portion provided in said first frame.

12. A process cartridge according to claim 11, wherein said reinforcing portion is radially provided on an outer side of said cylindrical portion.

13. A process cartridge according to claim 12, further comprising at least one additional reinforcing portion.

14. A process cartridge according to claim 11, wherein said reinforcing portion connects said charging member support portion to said cylindrical portion.

15. A process cartridge according to claim 11, wherein said reinforcing portion, said charging member support portion, and said cylindrical portion provided in said first frame are integrally formed.

16. A process cartridge according to claim 11, wherein one end of said connecting pin is supported by said first hole, and wherein the other end of said connecting pin is supported by said second hole.

17. A process cartridge according to any one of claims 11 to 16, wherein said reinforcing portion is in a form of a rib.

18. An electrophotographic image forming apparatus to which a process cartridge is detachably mountable for forming an image on a recording medium, said electrophotographic image forming apparatus comprising:

(i) a mounting member configured and positioned to detachably mount a process cartridge, the process cartridge including: an electrophotographic photosensitive drum; a charging member configured and positioned to charge the electrophotographic photosensitive drum; a developing member configured and positioned to develop with toner an electrostatic latent image formed on the electrophotographic photosensitive drum; a first frame supporting the electrophotographic photosensitive drum and the charging member; a second frame supporting the developing member; a first hole provided in the first frame; a second hole provided in the first frame; a third hole provided in the second frame; a connecting pin extending through the first hole, the second hole, and the third hole to rotatably connect the second frame to the first frame by being force fitted into the second hole; and a reinforcing portion provided on a downstream side of the first frame with respect to a direction in which the connecting pin is force-fitted so as to restrain deformation of the second hole when force-fitting the connecting pin into the second hole, wherein the second hole is formed in a cylindrical portion provided in the first frame; and (ii) conveying means for conveying the recording medium.

* * * * *